US007471249B2

(12) United States Patent
Tang et al.

(10) Patent No.: US 7,471,249 B2
(45) Date of Patent: Dec. 30, 2008

(54) EMC METAL-PLATE ANTENNA AND A COMMUNICATION SYSTEM USING THE SAME

(75) Inventors: Chia-Lun Tang, Miaoli County (TW); Kin-Lu Wong, Kaohsiung (TW); Chih-Ming Su, Taipei (TW)

(73) Assignees: Industrial Technology Research Institute, Hsinchu (TW); National Sun Yat-sen University, Kaohsiung (TW)

( * ) Notice: Subject to any disclaimer, the term of this patent is extended or adjusted under 35 U.S.C. 154(b) by 207 days.

(21) Appl. No.: 11/307,070

(22) Filed: Jan. 23, 2006

(65) Prior Publication Data

US 2007/0109196 A1 May 17, 2007

(30) Foreign Application Priority Data

Nov. 15, 2005 (TW) ..... 94140042 A

(51) Int. Cl.
*H01Q 1/24* (2006.01)

(52) U.S. Cl. ..... 343/702; 343/841

(58) Field of Classification Search ..... 343/702, 343/841, 700 MS, 846
See application file for complete search history.

(56) References Cited

U.S. PATENT DOCUMENTS 5,754,145 A * 5/1998 Evans ..... 343/795
5,841,401 A * 11/1998 Bodley et al. ..... 343/700 MS
5,949,385 A * 9/1999 Asakura et al. ..... 343/895
5,966,096 A * 10/1999 Brachat ..... 343/700 MS
6,008,774 A * 12/1999 Wu ..... 343/828
6,717,548 B2 4/2004 Chen ..... 343/700 MS
6,801,166 B2 * 10/2004 Mikkola et al. ..... 343/700 MS
6,856,294 B2 2/2005 Kadambi et al. ..... 343/702
2003/0103014 A1 * 6/2003 Birnbaum et al. ..... 343/841
2004/0051669 A1 * 3/2004 Rutfors et al. ..... 343/702
2004/0160369 A1 * 8/2004 Wong et al. ..... 343/702
2007/0008224 A1 * 1/2007 Chung et al. ..... 343/700 MS
2007/0063901 A1 * 3/2007 Tang et al. ..... 343/702
2007/0085742 A1 * 4/2007 Kikin ..... 343/700 MS

OTHER PUBLICATIONS

"EMC Internal Patch Antenna for UMTS Operation in A Mobile Device" jointly authored by Su et al., published by Antennas and Propagation, IEEE Transactions on Antennas and Propagation, vol. 53, No. 11, on Nov. 2005, pp. 3836-3839.

* cited by examiner

*Primary Examiner*—HoangAnh T Le
(74) *Attorney, Agent, or Firm*—Jianq Chyun IP Office

(57) ABSTRACT

An EMC (electromagnetic compatible) antenna having a shielding metal wall to effectively reduce the possible coupling with nearby electronic elements is presented. The antenna includes: a ground plane, a bent ground plate, and a radiating plate. The bent ground plate is vertically connected to the ground plane and functions as an effective shielding metal wall to eliminate or greatly reduce the possible EM coupling between the antenna and nearby electronic elements. The radiating plate is used to generate the operating resonant mode of the antenna and is generally parallel to the ground plane. The radiating plate is also electrically connected to and encircled by the bent ground plane.

18 Claims, 6 Drawing Sheets

EMC METAL-PLATE ANTENNA AND A COMMUNICATION SYSTEM USING THE SAME

CROSS-REFERENCE TO RELATED APPLICATION

This application claims the priority benefit of Taiwan application serial no. 94140042, filed on Nov. 15, 2005. All disclosure of the Taiwan application is incorporated herein by reference.

BACKGROUND OF THE INVENTION

1. Field of Invention

The present invention relates to an EMC (electromagnetic compatible) metal-plate antenna and a communication system using the same, and particularly to a built-in EMC antenna and a communication system using the same, which is capable of effectively reducing possible electromagnetic coupling between the antenna and other electronic elements without an isolation spacing.

2. Description of Related Art

Along with the thriving development of wireless communications, various communication products and communication technologies are being emerged in flourish, and the wireless communication products have gradually become an indispensable part in people's living. With drastic competitions in the market, a wireless communication apparatus is required to be lighter, thinner and smaller. Thus, a built-in antenna and the performance thereof play a significant role.

Modern wireless communication products at least include an antenna, a battery, a RF circuit module (radio frequency circuit module) and other electronic components. High-level product even includes a digital camera lens of CCD (charge coupling device). Therefore, if the spacing between the antenna and other components is not large enough, a negative electromagnetic coupling occurs, which leads to the degradation in the antenna performance. Hence, to apply an antenna in a wireless communication apparatus, the EMC influence of the surroundings must be considered, which increases the difficulty of design.

To reduce the electromagnetic coupling, an isolation spacing between the antenna and other components is preserved to sustain the antenna performance. However, the isolation spacing preservation reduces usable spaces inside the wireless communication apparatus, and also limits a wireless communication apparatus to be light and compact. Besides, since the electromagnetic coupling between the antenna and other components would be varied by the position change of other components, large effects on the antenna performance are expected.

Some conventional arts, for example U.S. Pat. No. 6,856,294 ('compact, lower profile, single feed, multi-band, printed antenna') and U.S. Pat. No. 6,717,548 ('dual- or multi-frequency planar inverted F-antenna') disclose built-in antennas. In U.S. Pat. No. 6,856,294, a spacing of about 6 mm between an antenna and a shielding metal case of a RF circuit module is required to assure the circuit characteristics (frequency, impedance, efficiency) to be normal. In U.S. Pat. No. 6,717,548, a spacing of about 7 mm is required not only between an antenna and a shielding metal case of a RF circuit module, but also between an antenna and a shielding metal wall of a digital camera lens, such that normal circuit characteristics can be obtained.

As a matter of fact, the above-mentioned antenna designs did not consider the shielding of an antenna itself yet. Therefore, when such kind of antennas is disposed near other electronic components, an extra spacing is required for reducing the electromagnetic coupling between the antenna and other electronic components, which results in an inefficient usage of the limited available space. If the spacing preserved is not sufficient, a frequency shift and an impedance change occur, which affect the signal quality and largely reduce the antenna performance due to the electromagnetic coupling.

In high-level mobile communication products, components disposed near to an antenna are usually a digital camera lens, a RF circuit module and a battery. In general, the above-mentioned components have their own shielding metal cases. However, the conventional antenna does not have its own shielding. When the distance between the antenna and the shielded components is too small, the antenna performance would be degraded due to a strong electromagnetic coupling. To reduce the coupling, an extra spacing between the conventional antenna and the components is required, which leads to an inefficient usage of the avaiable space inside the mobile communication apparatus. Besides, when the position relation changes between the antenna and other components, the antenna performances would be varied, and the antenna needs to redesigned, leading to a labor waste.

From the above description, an EMC (electromagnetic compatible) metal-plate antenna and a communication system using the same are demanded, which are capable of effectively reducing possible electromagnetic coupling between the antenna and other electronic components without an isolation spacing.

SUMMARY OF THE INVENTION

An aspect of the present invention is to provide a built-in antenna, to which spacing from other major components is not needed while the antenna still possesses the electromagnetic compatible behavior to effectively decrease the influence on the antenna from other electronic components near to the antenna. Thus, the inside usable capacity of a wireless communication system is increased and the size of the wireless communication apparatus can be further compact.

Another aspect of the present invention is to provide a built-in antenna of unified design by metal processing to reduce fabrication cost.

Another aspect of the present invention is to provide an EMC (electromagnetic compatible) built-in antenna, capable of increasing the compatibility between the antenna and other components and adaptation in a wireless communication apparatus. In other words, the flexibility to dispose an antenna inside a wireless communication apparatus is increased.

Another aspect of the present invention is to provide an EMC built-in antenna. The antenna can be applicable to different wireless communication products without modifying the antenna for wireless products standardizing.

An embodiment of the present invention provides an EMC antenna, which includes: a ground plane, an antenna shielding metal wall and a radiator. The ground plane provides the signal ground. The antenna shielding metal wall is roughly perpendicular to the ground plane. The antenna shielding metal wall is formed by bending a plate-like part once and is electrically connected to the ground plane. The radiator generates operating resonant modes of the antenna and is electrically connected to the antenna shielding metal wall. The radiator is parallel to the ground plane and encircled by the antenna shielding metal wall.

Another embodiment of the present invention provides a wireless communication apparatus, which includes: an internal component; and an EMC built-in antenna. The EMC built-in antenna has an antenna shielding metal wall, capable of effectively reducing electromagnetic coupling between the antenna and the internal components and avoiding the antenna from the signal influence of the internal components. There is no spacing required between the antenna and the internal components.

Another embodiment of the present invention provides a method for improving the receiving and transmitting quality of wireless signals in a wireless communication apparatus. The wireless communication apparatus includes a built-in antenna and a signal source. The method includes: providing the wireless communication apparatus with a common ground plane; providing the built-in antenna with an electromagnetic shielding metal wall electrically connected to the common ground plane. The electromagnetic shielding metal effectively encircles the built-in antenna and is capable of effectively protecting the built-in antenna from electromagnetic coupling of the signal source such to improve the receiving and transmitting operations of the wireless signals of the built-in antenna. There is no preserved spacing needed between the built-in antenna and the signal source. Even if other signal sources are added in the wireless communication apparatus, the whole behavior of the built-in antenna almost does not change.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
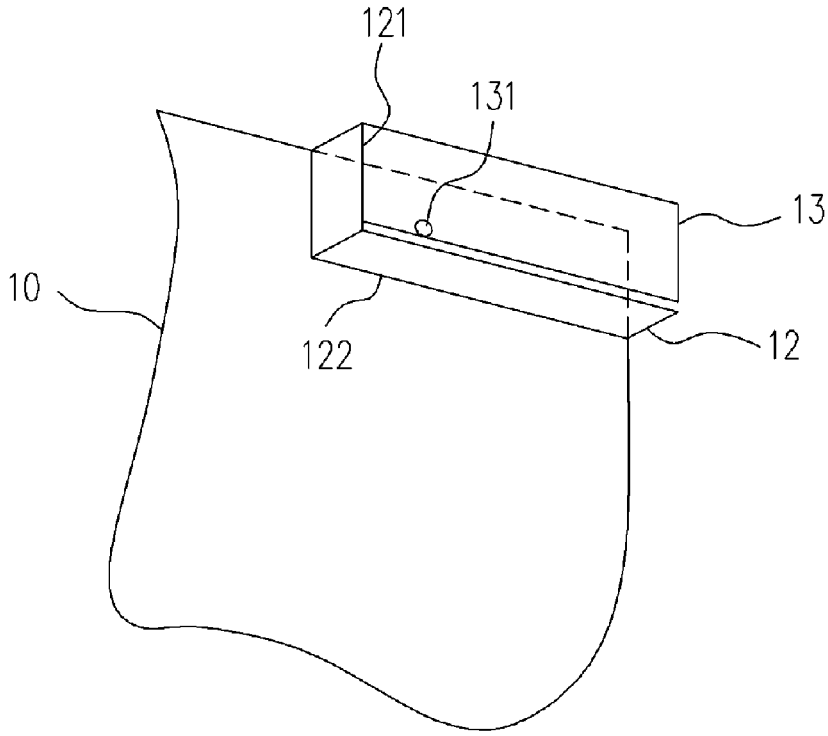
FIG. 1 shows an antenna structure according to a first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
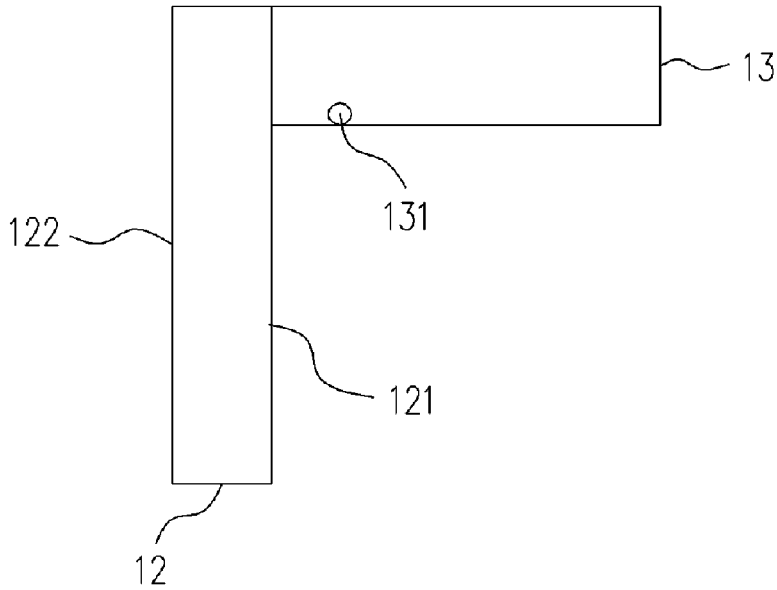
FIG. 2 is an extended diagram of the bent ground plate and the radiating plate in an antenna of the first embodiment.

Referring to FIGS. 1 and 2 for showing an antenna according to a first embodiment of the present invention. The antenna mainly includes a ground plane 10, a bent ground plate 12 and a radiating plate 13. The ground plane 10 is for signal ground of the entire antenna and the communication system using the antenna.

The bent ground plate 12 is perpendicular to the ground plane 10 and used as an electromagnetic shielding metal wall of the antenna for providing the antenna with a required shielding effect to effectively decrease the influence on the antenna from other electronic components (or signal sources) surrounding the antenna. The bent ground plate 12 is formed of a rectangle-like metal plate or a plate plated by metal or the equivalent. The bent ground plate 12 is formed by bending the rectangle-like metal plate or the plated plate at least once. In addition, the shape thereof after the bending is roughly of an L shape. The bent ground plate 12 has a first edge 121 and a second edge 122. The second edge 122 is electrically connected to the ground plane 10.

The radiating plate 13 is for generating operating resonant modes of the antenna. The radiating plate 13 has a signal feeding point 131 and is parallel to the ground plane 10. The radiating plate 13 is formed of a metal plate or a plate plated with metal or the equivalent. The radiating plate 13 is electrically connected to the first edge 121 of the bent ground plate. To effectively reduce electromagnetic coupling between the antenna and other components, the radiating plate 13 is encircled by the bent ground plate 12.

FIG. 2 is an extended diagram of the bent ground plate 12 and the radiating plate 13 in the antenna according to the first embodiment.

Figure 3:
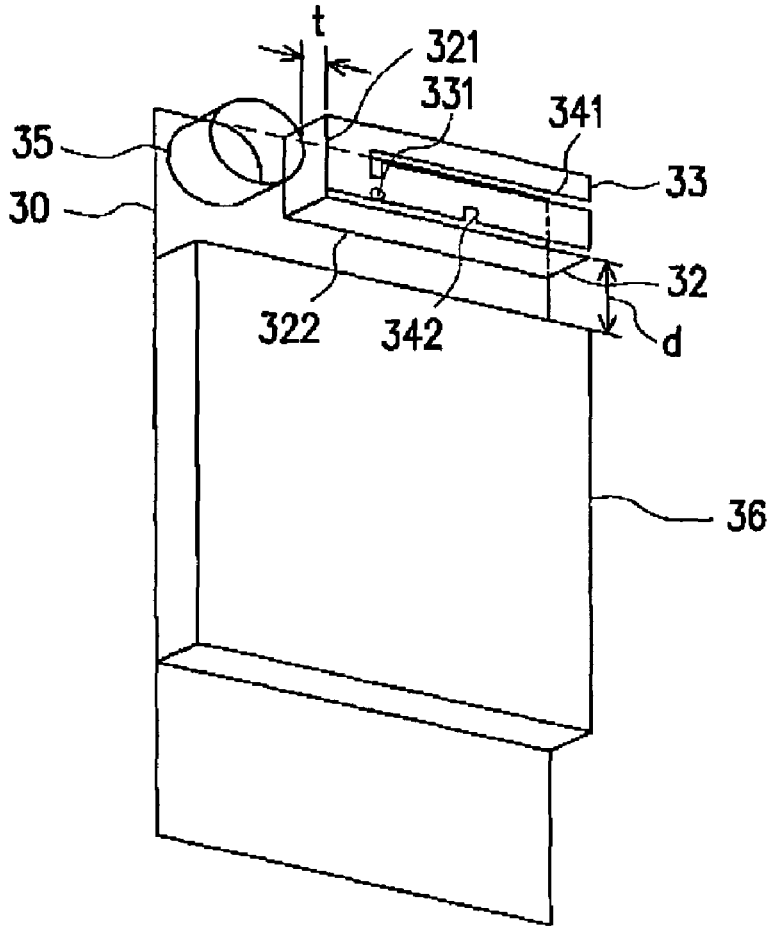
FIG. 3 is a schematic drawing showing disposition relations between an antenna, a shielding metal wall of a digital camera lens and a shielding metal case of a RF circuit module according to a second embodiment of the present invention.
Figure 4:
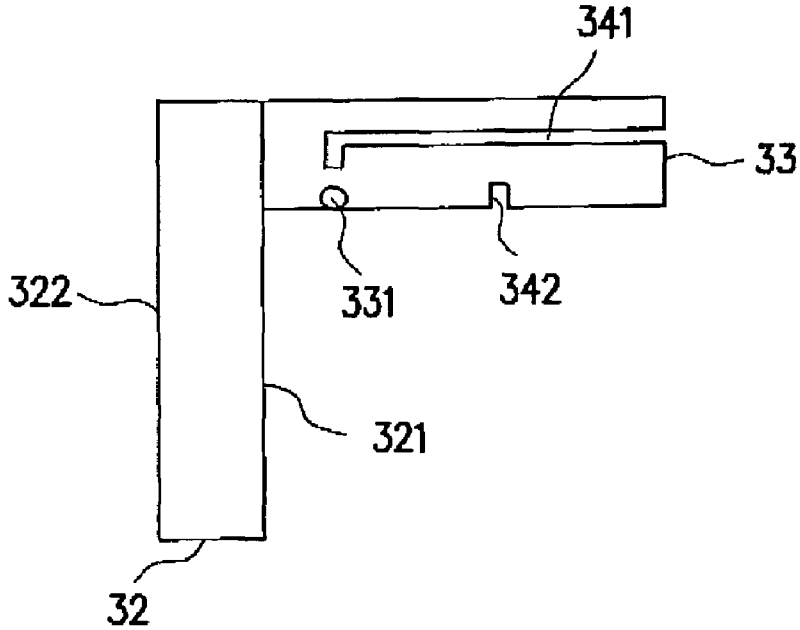
FIG. 4 is an extended diagram of the bent ground plate and the radiating plate in an antenna of the second embodiment.

FIGS. 3 and 4 are schematic showing an antenna structure according to a second embodiment of the present invention. FIG. 3 illustrates the disposition relations between an antenna, a shielding metal wall 35 of a digital camera lens and a shielding metal case 36 of a RF circuit module according to the second embodiment of the present invention.

The antenna architecture of the second embodiment mainly includes a ground plane 30, a bent ground plate 32 and a radiating plate 33. The bent ground plate 32 is perpendicular to the ground plane 30 and is formed of a rectangle metal plate or a plate plated with metal or the equivalent. The bent ground plate 32 is formed by bending the metal plate or the plated plate at least once. In addition, the shape thereof after the bending is roughly of an L shape. The bent ground plate 32 has a first edge 321 and a second edge 322. The second edge 322 is electrically connected to the grounded plane 30. The radiating plate 33 is for generating operating resonant modes of the antenna. The radiating plate 33 has a signal feeding point 331 and two gaps 341 and 342, and is roughly parallel to the ground plane 30. The radiating plate 33 is electrically connected to the first edge 321 of the bent ground plate and encircled by the bent ground plate 32. The gap 341 makes two resonant paths in the radiating plate 33. The two resonant paths have two resonant lengths close to each other for forming a wider operating band. The gap 342 is used for fine-adjusting the resonant paths of the antenna to slightly modify the center frequency of the antenna operating resonant modes. Number, shapes and sizes of the gaps are not limited by the figure, as long as the required functions are achieved.

The above-described first embodiment and the second embodiment are suitable for the situation where at both the left side and the lower side (as shown by the orientations in the figures) of the antenna reside other interference components (such as a digital camera lens, a RF circuit module and other signal sources).

In the tests of deciding whether the antenna of the second embodiment of the present invention is affected by other components or not, the distance between the shielding metal wall 35 of a digital camera lens and the bent ground plate 32 is defined as "t"; while the distance between the shielding metal case 36 of a RF circuit module and the bent ground plate 32 is defined as "d". FIG. 4 is an extended diagram of the bent ground plate 32 and the radiating plate 33 in the antenna of the second embodiment.

Figure 5:
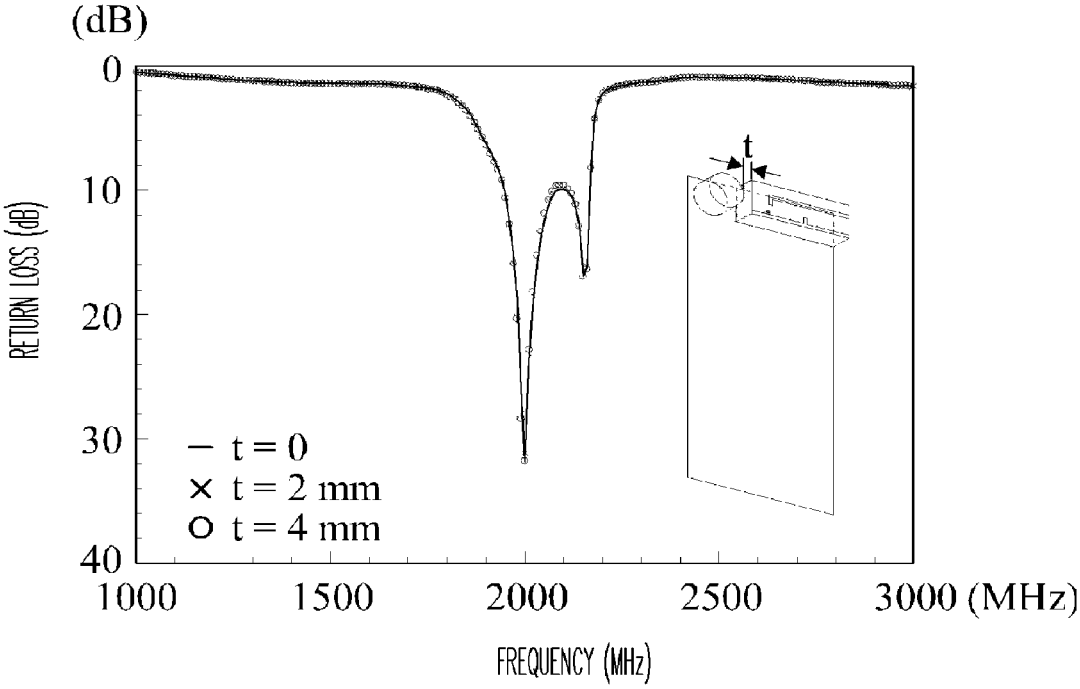
FIG. 5 is a diagram showing the return loss results between the antenna and the shielding metal wall of the digital camera lens according to the second embodiment of the present invention.

FIG. 5 is a diagram showing the measured return loss between the antenna and the shielding metal wall of the digital camera lens according to the second embodiment of the present invention. In the experiment, the length of the ground plane 30 is about 100 mm and the width thereof is about 60 mm; the lengths of L-shape's two arms of the bent ground plate 32 are about 10 mm and 35 mm, respectively and the height thereof is about 7 mm; the length of the radiating plate 33 is about 34 mm and the width thereof is about 9 mm; the distance between signal feeding point 331 and the first edge 321 of the bent ground plate 32 is about 5 mm; the length of the gap 341 is about 31.5 mm and the length of the gap 342 is about 1.5 mm; the diameter of the shielding metal wall 35 of a digital camera lens is about 10 mm and the height thereof is 7 mm. In addition, a coaxial cable is used to feed signals for testing the antenna, wherein the central conductor of the coaxial cable is connected to the feeding point, while the grounding sheath thereof is connected to the bent ground plate.

It is clear from the measured results that with the definition of 2.5:1 voltage standing wave ratio, the impedance bandwidth of the antenna covers the frequency band of 3G (the third generation) mobile communication, i.e. 1920~2170 MHz. Note that the impedance bandwidth is not varied by a variation of the distance t between the shielding metal wall 35 of the digital camera lens and the bent ground plate. That is to say the antenna is not influenced by the digital camera lens. Even if the antenna is contacted thereby (t=0), the antenna still meets the operation requirements. Thus, the antenna configuration shown by the second embodiment of the present invention can meet the operation frequency band requirement (1920~2170 MHz) of the 3G mobile communication and is suitable for the mobile phone application.

Figure 6:
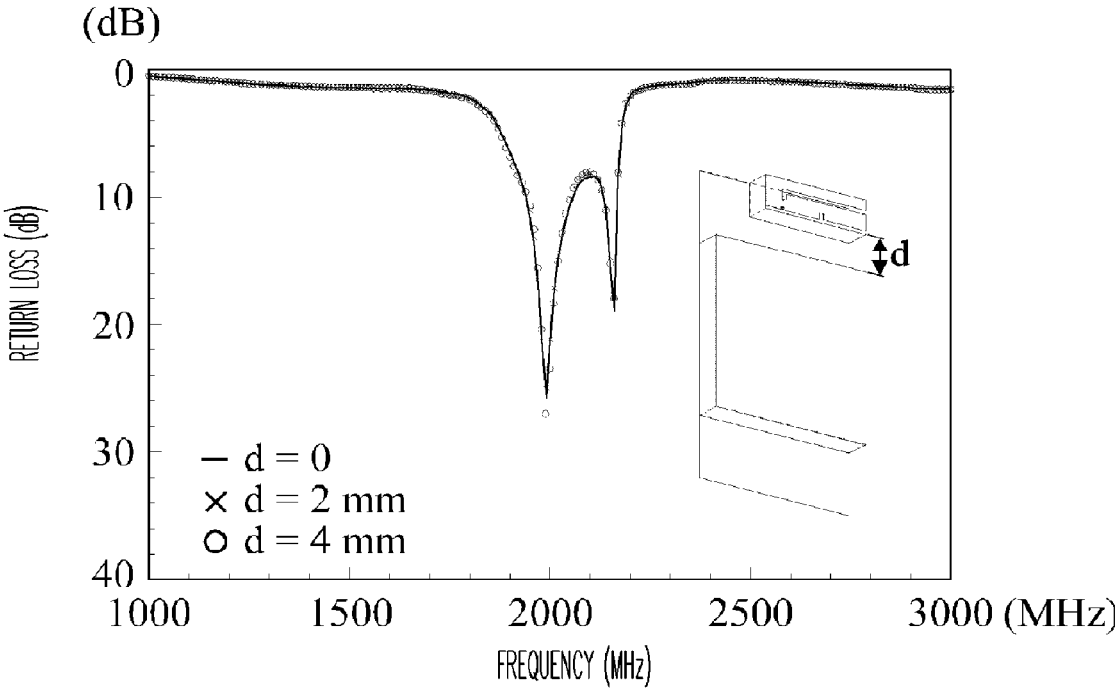
FIG. 6 is a diagram showing the return loss results between the antenna and the shielding metal case of the RF circuit module according to the second embodiment of the present invention.

FIG. 6 is a diagram showing the measured return loss between the antenna and the shielding metal case of the RF circuit module according to the second embodiment of the present invention. Other parameters in FIG. 6 are the same as FIG. 5, but the length, width and the height of the shielding metal case of a RF circuit module 36 are 60 mm, 60 mm and 7 mm, respectively. The measured results demonstrate that, with the definition of 2.5:1 voltage standing wave ratio, the impedance bandwidth covers the frequency band required by the 3G mobile communication. In addition, the impedance bandwidth of the antenna does not vary with a variation of the distance d between the shielding metal case of the RF circuit module and the bent ground plate. That is to say the antenna is not influenced by the RF circuit module. Even if the antenna is contacted thereby (d=0), the antenna still meets the operation requirement.

Figure 7:
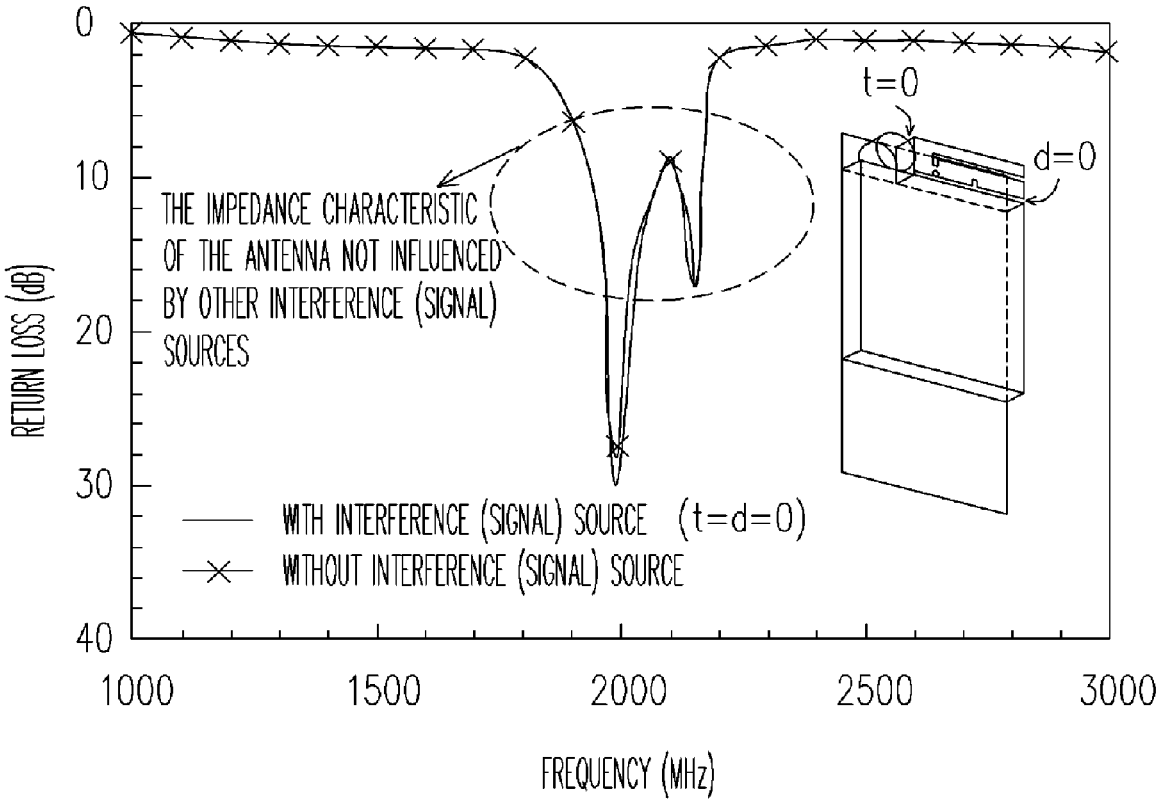
FIG. 7 is a diagram showing the return loss results between the antenna, the shielding metal wall of the digital camera lens and the shielding metal case of the RF circuit module according to the second embodiment of the present invention.

FIG. 7 is a diagram showing the measured return loss between the antenna with and without other interference (signal) sources according to the second embodiment of the present invention. Other parameters are the same as the parameters in FIGS. 5 and 6; except for t=d=0 (spaces between the antenna and other signal sources are zero), which indicates the interference sources (for example, the shielding metal case 36 of the RF circuit module and the shielding metal wall 35 of the digital camera lens) are in direct contact with the bent ground plate. In FIG. 7, "-" curve represents the measured results with the presence of an interference source, while "x" curve represents the measured results without the presence of an interference source. The measured results further prove that the interference sources have no influence on the impedance characteristic of the invented antenna. Besides, with the definition of 2.5:1 voltage standing wave ratio, the impedance bandwidth of the antenna of the second embodiment can cover the frequency band required by the 3G mobile communication, i.e. 1920~2170 MHz. That is to say, the antenna of the embodiment can be disposed with other components without a spacing preserved and the antenna still meets the operation requirement.

Figure 8:
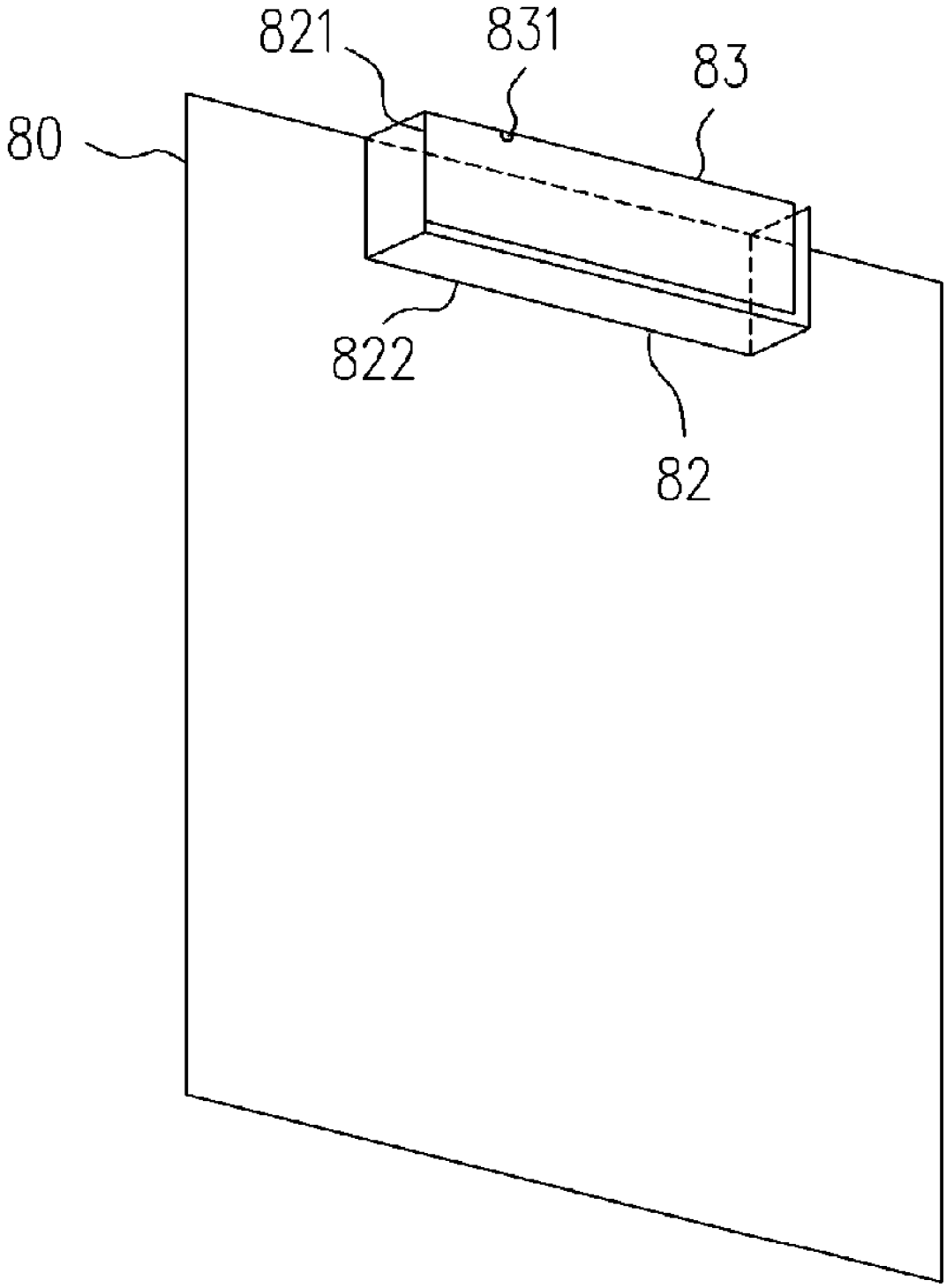
FIG. 8 is a schematic showing an antenna structure according to a third embodiment of the present invention.

FIG. 8 is a schematic showing an antenna structure according to a third embodiment of the present invention. The antenna includes a ground plane 80, a bent ground plate 82 and a radiating plate 83. The bent ground plate 82 is formed of a rectangle-like metal plate or a plate plated with metal or the equivalent. The bent ground plate 82 is formed by bending the metal plate or the plate plated twice and has a U-like shape after the bending. Similarly, the bent ground plate 82 has a first edge 821 and a second edge 822. The radiating plate 83 is for generating operating resonant modes of the antenna and has a signal feeding point 831. The antenna structure enables the antenna to be easily disposed with other electronic components inside a wireless communication apparatus without any influence on the antenna performance under no space preserved. The third embodiment is suitable for the situation where the left side, the lower side and the right side (as shown by the orientations in the figures) of the antenna reside other interference components (such as a digital camera lens and a RF circuit module).

Figure 9:
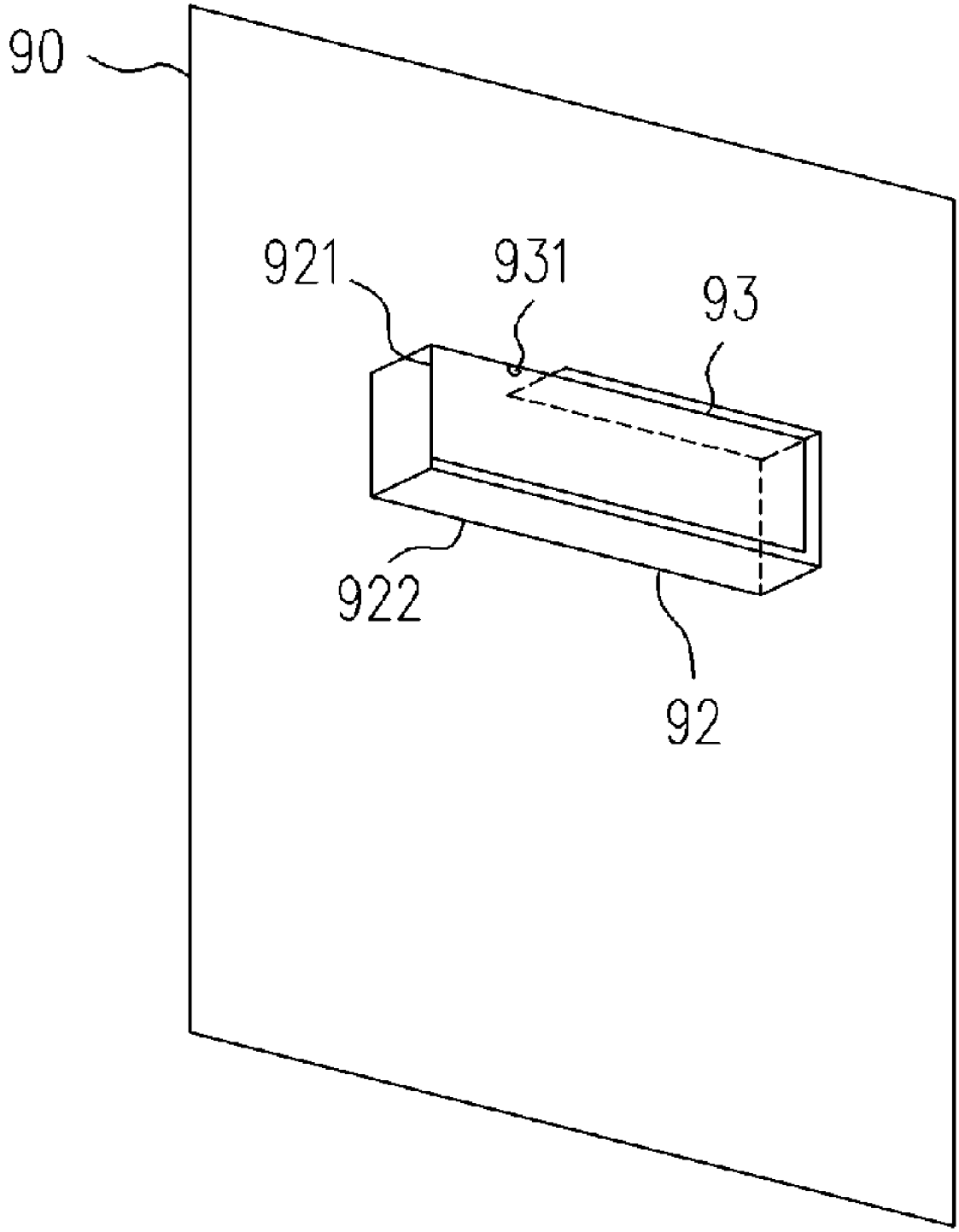
FIG. 9 is a schematic showing an antenna structure according to a fourth embodiment of the present invention.

FIG. 9 is a schematic showing an antenna structure according to a fourth embodiment of the present invention. The antenna includes a ground plane 90, a bent ground plate 92 and a radiating plate 93. The bent ground plate 92 is formed by a roughly rectangle-like metal plate or a plate-like part plating metal or the equivalent, needing multiple bending and having a C-like shape after the bending. Similarly, the bent ground plate 92 has a first edge 921 and a second edge 922. The radiating plate 93 is for generating operating resonant modes of the antenna and has a signal feeding point 931. The antenna structure enables the antenna to be easily disposed with other electronic components inside a wireless communication apparatus without any influence on the antenna performance under no space preserved. The fourth embodiment is suitable for the situation where at all of the left and right sides and the lower and right sides (as shown by the orientations in the figures) of the antenna reside other interference components (as above described, such as a digital camera lens and a RF circuit module).

Although gaps are not shown in FIG. 1, FIG. 8 and FIG. 9, similarly with the second embodiment, the first, the third and the fourth embodiments further include gaps, respectively, to further intensify the efficiency thereof. In addition, the antennas of the embodiments are designed as built-in.

From all the above described, the antennas disclosed by the aforesaid embodiments of the present invention have advantages of structure simplicity, low fabrication cost and tangible functions.

The bent ground plate and the radiating plate are formed by cutting or punching a metal plate or a metal-plated plate. The radiating plate can be formed on a microwave substrate by printing or etching technology.

In summary, the antenna architecture disclosed by the embodiments of the present invention enables to effectively reduce electromagnetic coupling between the antenna and other components without any space preservation. Therefore, the antenna architecture is able to advance available space usage of a wireless communication product having the antenna and further downsize the wireless communication product. Furthermore, a metal process can be used for the antenna to be a unified body such to further reduce the fabrication cost. Moreover, since such an antenna is used in a wireless communication apparatus, the flexibility for the wireless communication apparatus using the antenna is enhanced, and antennas of the same type allow to be used in different wireless products without any design modification, for antenna standardizing.

Besides, a further embodiment of the present invention discloses a wireless communication apparatus, which uses a built-in antenna provided by the above-described embodiments and contains other signal sources.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. An electromagnetic compatible (EMC) antenna, comprising:

a ground plane for signal ground;

an antenna electromagnetic shielding wall, perpendicular to the ground plane, wherein the antenna electromagnetic shielding wall is formed of a plate by bending the plate at least once and electrically connected to the ground plane; and a radiator, used for generating operating resonant modes of the antenna, electrically connected to the antenna electromagnetic shielding wall, parallel to the ground plane and encircled by the antenna electromagnetic shielding wall.

2. The antenna of claim 1, wherein the plate is roughly rectangle-like.

3. The antenna of claim 1, wherein the antenna electromagnetic shielding wall roughly has an L-like shape after bending.

4. The antenna of claim 1, wherein the antenna electromagnetic shielding wall roughly has a U-like shape after bending.

5. The antenna of claim 1, wherein the antenna electromagnetic shielding wall roughly has a C-like shape after bending.

6. The antenna of claim 1, wherein the antenna electromagnetic shielding wall has a first edge and a second edge, the first edge being electrically connected to the radiator, while the second edge being electrically connected to the ground plane.

7. The antenna of claim 1, wherein both the antenna electromagnetic shielding wall and the radiator are formed of a metal plate or a metal-plated plate after cutting or punching.

8. The antenna of claim 1, wherein the radiator is formed on a microwave substrate by printing or etching technology.

9. The antenna of claim 1, wherein the radiator comprises:

a signal feeding point, connected to a signal source for feeding signals to the antenna;

a first gap for partitioning the radiator into a plurality of resonant paths possessing approximate resonant lengths to each other for forming the operating bandwidth of the antenna; and a second gap, used for fine-adjusting the resonant paths to modify the center frequency of the operating bandwidth of the antenna.

10. The antenna of claim 1, wherein peripheries of the radiator and the antenna electromagnetic shielding wall have a non-contact portion, forming a strip gap.

11. A wireless communication apparatus, comprising:

an internal signal source; and an electromagnetic compatible (EMC) built-in antenna, having an antenna electromagnetic shielding wall to reduce electromagnetic coupling between the antenna and the internal signal source;

wherein the antenna further comprises:

a ground plane for signal ground; and a radiator, used for generating operating resonant modes of the antenna, electrically connecting to the antenna electromagnetic shielding wall, parallel to the ground plane and encircled by the antenna electromagnetic shielding wall; wherein, the antenna electromagnetic shielding wall is perpendicular to the ground plane, formed of a plate by bending at least once and electrically connected to the ground plane.

12. The wireless communication apparatus of claim 11, wherein the antenna electromagnetic shielding wall has a first edge and a second edge; the first edge is electrically connected to the radiator, while the second edge is electrically connected to the ground plane.

13. The wireless communication apparatus of claim 11, wherein the radiator comprises:

a signal feeding point, connected to another signal source for feeding signals to the antenna;

a first gap for partitioning the radiator into a plurality of resonant paths possessing approximate resonant lengths to each other for forming the operating bandwidth of the antenna; and a second gap, used for fine-adjusting the resonant paths to modify the center frequency of the operating bandwidth of the antenna.

14. The wireless communication apparatus of claim 11, wherein no preserved spacing is needed between the antenna and the internal signal source.

15. The wireless communication apparatus of claim 11, wherein peripheries of the radiator and the antenna electromagnetic shielding wall have a non-contact portion, forming a strip gap.

16. A method for improving the receiving and transmitting quality of wireless signals in a wireless communication apparatus, wherein the wireless communication apparatus comprises a built-in antenna and a signal source; the method comprising:

providing the wireless communication apparatus with a common electrical ground plane; and providing the built-in antenna electrically connected with an electromagnetic shielding wall, wherein the electromagnetic shielding wall is electrically connected to the ground plane, encircles the built-in antenna to protect the built-in antenna from an electromagnetic influence by the signal source.

17. The method for improving the receiving and transmitting quality of wireless signals in a wireless communication apparatus of claim 16, wherein no preserved spacing is needed between the built-in antenna and the signal source.

18. The method for improving the receiving and transmitting quality of wireless signals in a wireless communication apparatus of claim 16, wherein in the step of providing the built-in antenna, peripheries of the built-in antenna and the antenna electromagnetic shielding wall have a non-contact portion, forming a strip gap.

* * * * *